US006158196A

United States Patent [19]

Trebbi et al.

[11] Patent Number: 6,158,196

[45] Date of Patent: Dec. 12, 2000

[54] TOOL FOR CAPPING BOTTLES WITH SCREW CAPS

[75] Inventors: Claudio Trebbi, Medicina; Luigi Cavina, Bologna, both of Italy

[73] Assignee: I.M.A. Industria Macchine Automatiche S.p.A., Bologna, Italy

[21] Appl. No.: 09/230,823

[22] PCT Filed: Jun. 29, 1998

[86] PCT No.: PCT/EP98/03952

§ 371 Date: Feb. 10, 1999

§ 102(e) Date: Feb. 10, 1999

[87] PCT Pub. No.: WO99/03772

PCT Pub. Date: Jan. 28, 1999

[30] Foreign Application Priority Data

Jul. 17, 1997 [IT] Italy ..... BO97A0436

[51] Int. Cl.[7] ..... B65B 7/28

[52] U.S. Cl. ..... 53/331.5; 53/75; 53/317

[58] Field of Search ..... 53/75, 317, 331.5

[56] References Cited

U.S. PATENT DOCUMENTS 3,184,897 5/1965 Shriner et al. ..... 53/331.5
5,321,935 6/1994 Spatz et al. ..... 53/75
5,400,564 3/1995 Humphries et al. ..... 53/75
5,417,031 5/1995 Bankuty et al. ..... 53/331.5

*Primary Examiner*—John Sipos
*Assistant Examiner*—Steven Jensen
*Attorney, Agent, or Firm*—Larson & Taylor PLC

[57] ABSTRACT

The cap is screwed on by a friction clutch (33) that gives a tightening torque less than the desired ideal torque. The cap (C) gripping head (47) is connected not only to the driven part of the clutch but also, through a composite drive shaft (233, 54), to a freewheel (57) engaging with a mechanism which, after the screwing of the cap by the clutch, is acted on by a wedge (89) of programmable and adjustable interference mounted on a guide connected to a load cell (84). When this mechanism is acted upon by the wedge, it receives from it the small rotation required to complete the screwing of the cap and the reaction of the wedge to the mechanism is detected by the load cell, which emits an electrical signal proportional to the effective tightening torque applied to the cap. In order to protect the mechanical friction clutch (33), the latter is clamped at a constant minimum value which it is possible to adjust via its pressure spring (42), whereas it is clamped to the operating value by a pneumatic servomechanism which is active only during the initial part of the cap screwing cycle.

17 Claims, 7 Drawing Sheets

TOOL FOR CAPPING BOTTLES WITH SCREW CAPS

FIELD OF THE INVENTION

The invention relates to carousel-type machines for closing bottles or the like with screw caps, and for these machines, which currently operate at sometimes very high speeds, it concerns a highly technologically reliable tool that is capable of being programmed through the machine control panel to satisfy the leaktight screwing requirements of the various shapes and/or sizes of bottles and caps acceptable by the carousel, which is able to monitor the screwing torque applied to each cap and if necessary also to adjust itself automatically with a feedback command, so as to ensure that the screwing torque is and remains at the predetermined level, in order that the caps are closed in such a way as to ensure the bottles are sealed—a condition which is particularly necessary for the storage of the packaged product—and at the same time in order to ensure that the caps can be unscrewed sufficiently easily when the time comes to use the product packaged in the said bottles.

BACKGROUND OF THE INVENTION

In order to monitor the screwing torque applied to screw caps on bottles, known devices exist with friction clutch means under elastic loading, which act basically as torque limiters. When the tightening torque varies the said elastic means must be adjusted. These known devices are not capable of producing operating conditions that are constant over time because of the variable reaction of the friction clutches in response to temperature, wear and other factors. Other known devices use dog clutches instead of friction clutches, loading them by pneumatic pressure which is variable in accordance with tightness requirements: when the desired screwing torque is reached one of the their components makes an axial movement which is detected by sensors so that the degree of tightness of the cap can be checked. The operation of these devices is however once again unreliable and inconstant over time as it again depends entirely on a clutch of the friction type.

BRIEF SUMMARY OF THE INVENTION

It is an object of the invention to overcome these and other disadvantages of the prior art in the following manner. The cap is screwed with the aid of friction clutch means that generate a tightening torque approximately equal to or slightly less than the desired ideal torque. The shaft which carries the cap gripping head and is connected to the driven part of the clutch, is connected through a freewheel to a mechanism which, after the screwing of the cap by the clutch, is acted on by a wedge of programmable and adjustable interference mounted on movable means connected to a load cell. When this mechanism is acted upon by the wedge, it receives from it the torque required to complete the screwing action and the reaction of the wedge to the said mechanism is detected by the load cell, which emits an electrical signal proportional to the effective tightening torque applied to the cap. In order to protect the mechanical friction clutch the invention also provides for the latter to be loaded at a minimum value by an adjustable elastic means and for the compressive load applied to the clutch to be raised to the required operating value by a piston/cylinder unit that is loaded with a fluid at the predetermined pressure. This condition continues for the period of time required to carry out the first phase of the cap screwing, after which it is removed so that the clutch is protected from overheating and wear.

BRIEF DESCRIPTION OF THE DRAWINGS

Other features of the invention, and the advantages it offers, will become clearer in the following description of a preferred embodiment thereof, illustrated purely by way of non-restrictive example in the figures of the five attached sheets of drawings, wherein.

DETAILED DESCRIPTION OF THE INVENTION

Figure 1:
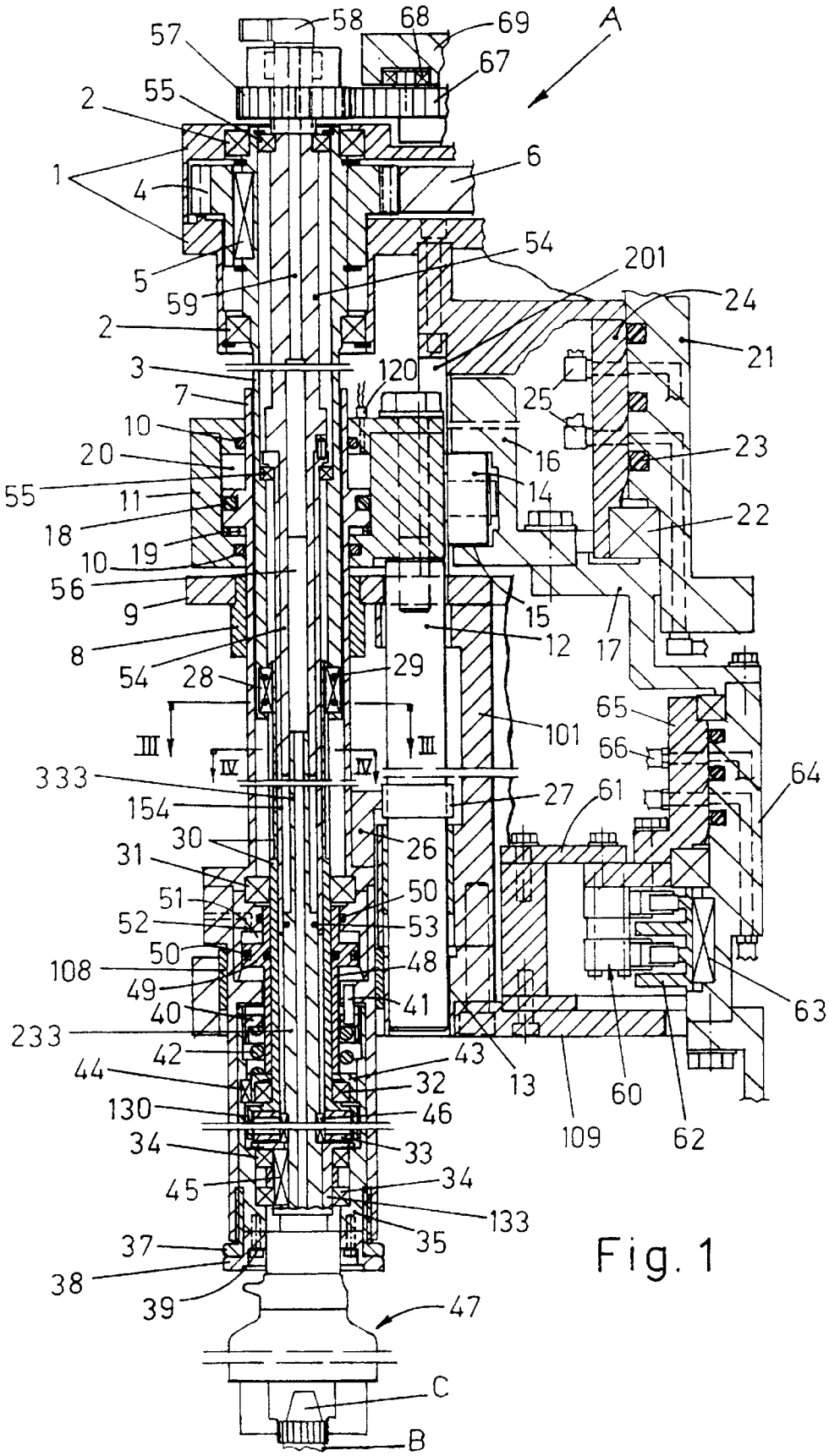
FIG. 1 is a longitudinal section through one of the tools for screwing on a screw cap, seen in the active working phase.
Figure 2:
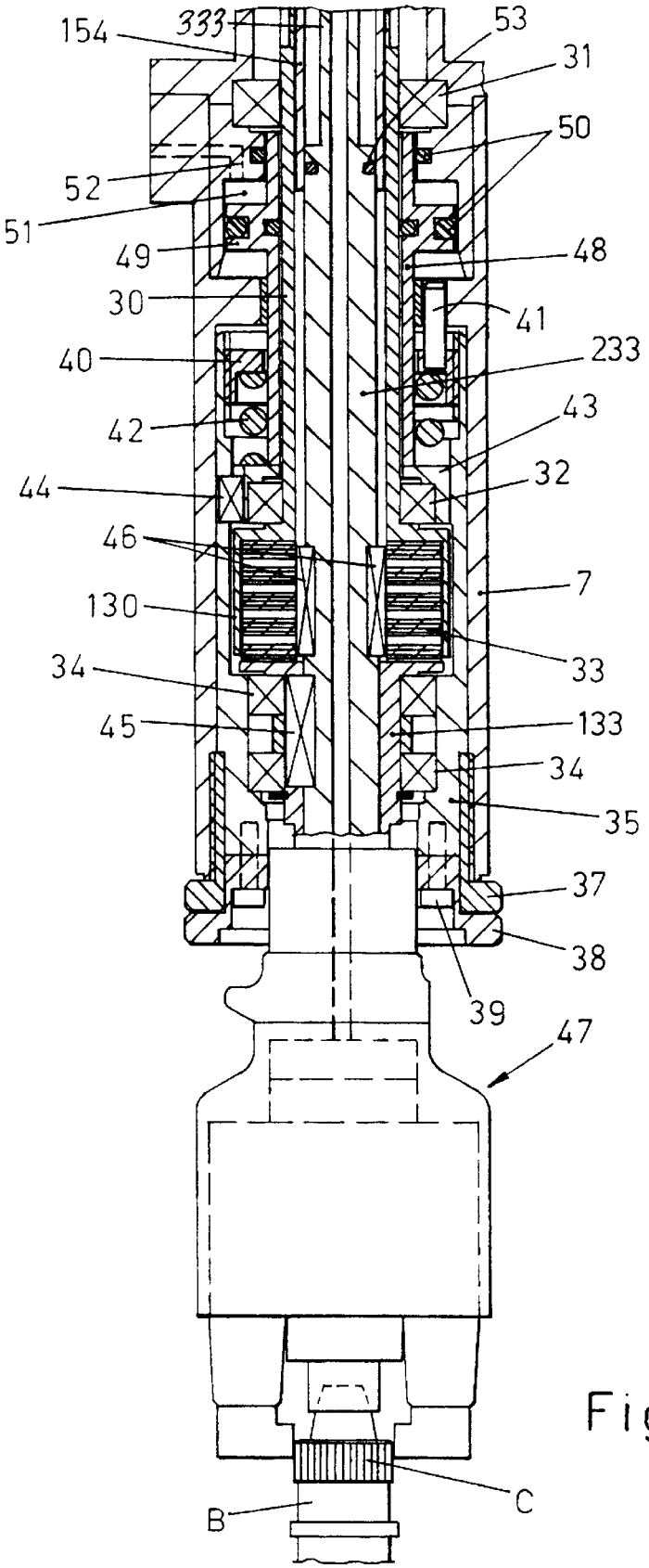
FIG. 2 is an enlarged view of the lower end of the tool seen in FIG. 1, with the cap gripping head and the mechanically and pneumatically loaded clutch that brings about the first stage of rotation of the gripping head.

In FIG. 1, A is a general reference for one of the vertical tools for closing bottles B or the like (only partly visible) with a screw cap C. The tool A is mounted with other identical tools, in the correct number and with equal angular spacing, around the periphery of a carousel that turns on a vertical axis. The details of the carousel are not shown as they are known in the sector of the technology to which the invention relates. The bottle B is fed in by suitable means underneath each capping tool A, aligned axially with the tool and held steady by suitable supporting means (not shown) and by a gripping head (not shown), the supporting means and gripping head being connected to the carousel, with which they rotate. When there is a change to the shape and/or size of the bottles to be capped, known means are provided for raising or lowering the entire upper section of the carousel with its capping tools relative to the said bottle supporting and steadying means, which remain at a fixed height.

In FIG. 1 the reference 1 indicates the upper plate of the carousel that rotates about a vertical axis and supports rotatably in bearings 2 the upper end of a vertical tube 3 which extends downwards. The plate 1 is made hollow and contains a gear 4 keyed by the key 5 to the said tube 3 and meshing with epicyclic gears of which a final component is marked 6 and which provides, for example, a fixed or contrarotating part in axial alignment with the carousel (not shown), such that as the plate 1 rotates about the vertical axis of the carousel, the gear 4 derives from the said epicyclic gears, and transmits to the tube 3, the rotation required to screw the cap (see below).

A tube 7 fits telescopically around the section of the tube 3 below the plate 1 and passes through guide bushes 8, 108 mounted in corresponding vertical seats in an intermediate horizontal plate 9 and in a lower horizontal plate 109 of the carousel, these plates being fixed to each other and to the plate 1 by means of annular jackets 101 and 201 coaxially positioned in the carousel and with suitable openings for the passage of various components. The top end of the tube 7 passes, with lateral leaktightness provided by the seals 10, through a cylinder 11 inside which there operates a laterally sealed piston 18 fixed axially to the said tube. The body of the said cylinder 11 extends towards the axis of the carousel and is fixed to a vertical plug 12 that leads down until its lower end passes through a vertical seat 13 formed in the said lower plate 109 of the carousel, in such a way that the said cylinder 11 is unable to rotate and can only make axial movements. Fixed to the side of the cylinder 11 nearest the axis of the carousel, in a radial arrangement relative to the carousel, is the horizontal spindle of a roller 14 engaged in the double-acting profile 15 of a known annular cam 16: the latter, which is situated coaxially with the carousel and mounted on the carousel's fixed part 17, is designed to control the approach to the bottle B of the movable lower part of the tool of the invention, carrying the cap C to be screwed into place (see below).

Inside the cylinder 11 there are two pressure chambers 19 and 20. These are defined by the opposite faces of the piston 18 and are connected to lines delivering a fluid at different pressure values. Specifically, pressure is created inside the lower chamber 19 to push the piston 18 upwards with sufficient force to compensate for and substantially cancel out the weight of the movable lower part of the tool which carries the cap and which is intended to press on the bottle. A constant pressure is set up inside the upper chamber 20 to oppose screwing, in such a way that, if during the phase of approach and screwing the cap jams on the threaded mouth of the bottle and refuses to screw down, the cylinder 11 can continue to move down while the tube 7 maintains a stationary height, thereby avoiding damage to the cap and bottle and the associated consequences. If this happens, the chamber 20 reduces in volume and its pressure would tend to rise if calibrated means (not shown) were not provided, such as a pressure relief valve, to switch and maintain the pressure in the said chamber at a constant and predetermined value. In addition to these means there may also be transducers indicated schematically at 120, e.g. a pressure switch, to detect the intervention of the said calibrated means or some equivalent function and signal to the processor controlling the machine (see below) that a particular tool A has malfunctioned.

Mounted on the said fixed part 17 of the carousel that supports the cam 16 is the fixed part 21 of a rotary distributor, to which are connected the compressed air delivery lines and with which there engages, by means of the bearings 22 and seals 23, the rotating part 24 of the distributor which is fixed to the plate 1 and from which the lines shown schematically as a whole at 25 branch off in order to supply the compressed air to the said chambers 19 and 20 and to other pressure chambers within the tool (see below).

Figure 3:
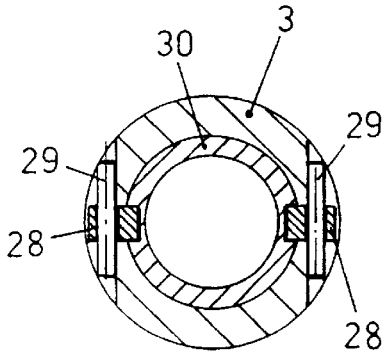
FIGS. 3 and 4 show details of keying with the possibility of axial movement for parts of the tool of FIG. 1, in section on planes III—III and IV—IV, respectively.

The tube 7 is prevented from rotating by a projection 26 on its side: by means of a bush 27 at its extremity, this projection moves in a guided way up and down the plug 12. The lower end of the tube 3 engages by means of keys 28, held in place by transverse pins 29 (see detail FIG. 3), with the longitudinally grooved upper end of a pipe 30. This pipe 30 is mounted in bearings 31, 32 to enable it to rotate inside the tube 7, and ends in a bell 130 that forms the driving part of a multiple-disc friction clutch 33. The lower driven part 133 of this clutch 33 is mushroom-shaped, is mounted rotatably by means of bearings 34 inside a bush 35 housed in the lower end of the tube 7, which extends beyond the bell 130 of the clutch, without interfering with the latter, and which is held axially in position by a nut 37 screwed into the corresponding tapped end of the tube 7. The bush 35 carries on its lower end a collar 38 fastened by screws 39, for the purpose of securing the said bush to the nut 37 and making it integral therewith. By slackening the screws 39 the collar 38 can be turned with an appropriate tool and, with it, the bush 35, so that the tapped part of its upper end screws an externally threaded retainer 40 up or down. The retainer 40 is prevented from rotating by a pin 41 held by an inward projection of the tube 7, which means that the said retainer can only move axially. The retainer 40 acts on the end of a cylindrical helical spring 42 whose other end presses on a retainer 43: this is keyed by a key 44 to the bush 35 and supports the lower bearing 32 of the pipe 30. By adjusting the load of the pressure spring 42, the pressure between the driving parts and the driven parts of the clutch 33 is modified, and this defines the limit value of the torque within which the said parts remain rotationally coupled to each other.

The driven parts of the clutch 33 also include a shaft 233 that passes axially and accurately through the hollow leg of the said mushroom-shaped driven part 133, which is coupled to it by the key 45 and which, by means of the keys 46, is integral with the driven discs of the said clutch. The lower end of the shaft 233 and of the leg of the driven part 133 of the clutch are provided with a quick-action coupling of known type for the keyed attachment of the known, usually pneumatically operated gripping head 47, which holds the cap as it screws it onto the bottle.

The lower part of the pipe 30 is inside a tubular rod 48 towards the top of which is a piston 49 with seals 50: this piston slides inside a pressure chamber 51 formed inside the tube 7. A line 52 leads into this chamber and is connected to means for the supply of a fluid, for example air, at the correct pressure. The value of the engagement torque of the clutch 33 is determined partly by the load of the spring 42 and partly by the pneumatic pressure transmitted by the piston 49. According to the invention the load exerted by the pressure spring 42 is a minimum value that is the same for all the tools A of the carousel, produced by tightening the aforesaid bushes 35 with a torque wrench. According to the invention, moreover, this value may remain constant even when there are changes to the shape and/or size of the bottles and of their caps which the present carousel is capable of screwing onto them—at least within a certain range of shapes and/or sizes. The value of the engagement torque of the clutch 33 is adjusted on each occasion to the specific requirements of the bottles and caps being processed, by adjusting the pneumatic pressure acting on the piston 49 via the machine control panel, using appropriate means indicated below. To protect the clutch, moreover, this pneumatic pressure is supplied for only a part of the cap screwing phase, as stated below.

Figure 4:
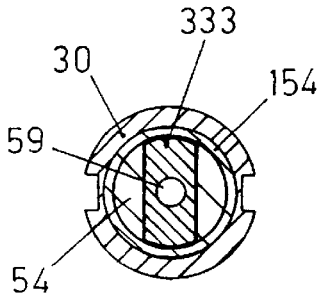

The shaft 233 that supports the cap C gripping head 47 engages a section of the pipe 30 with a radial play such that it can fit, with the seal 53 for lateral leaktightness, in the tubular end 154 of a composite shaft 54. This shaft 54 is mounted rotatably in the tube 3 on bearings 55 and is provided at the lower end of its core within the said tubular part 154, with a diametrical incision 56 containing a flattened part 333 of the said shaft 233 which is thereby keyed to the upper shaft 54 but with the ability to move axially relative to the latter (see also detail FIG. 4). The shaft 54 projects above the top of the plate 1 sufficiently to take a freewheeling gear 57, of which more later, and the very top of the same shaft 54 is fitted with a rotary coupling 58 connected to a compressed air delivery line for closing the gripping head 47 which is normally held open by spring means. The compressed air reaches the internal piston/cylinder unit controlling the gripping head 47 after passing through holes indicated generally by the reference 59, which run axially through the composite shaft 54, the subsequent shaft 333, 233 and the coupling part of the said gripping head.

The air lines, whose pressure must be adjustable to enable the friction of the clutch 33 to be set at the use level and the gripping head 47 to be closed, come from respective valves bearing the general reference 60. The valves 60 are mounted on a bell-shaped support 61 fixed coaxially to the plate 109 and also partly mounted directly on this plate. They are acted upon by cams 62 keyed 63 to the fixed body 64 of a rotating distributor connected to fixed air supply lines (not shown). The rotating part 65 of the distributor, which acts in combination with the said fixed part 64, is fixed to the frame 61 and is the starting point for the various lines indicated by the general reference 66 which connect to the various aforesaid valves 60. The outlets of the valves 60 are connected to the rotary coupling 58 and to the pressure chamber 51 of the various tools A.

Figure 5:
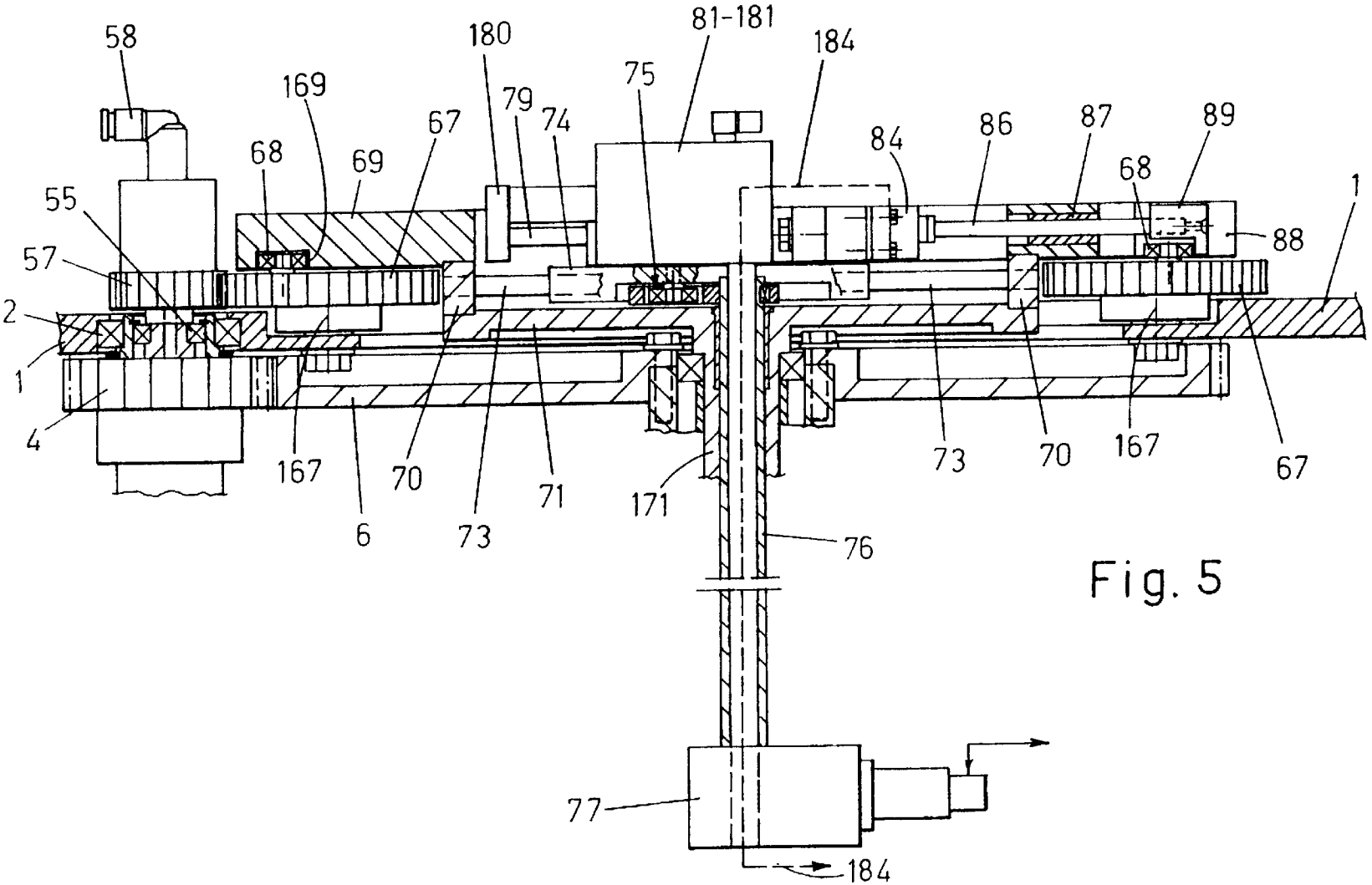
FIG. 5 shows the upper section of the capping carousel carrying the tools in question, and seen in section on a vertical plane containing the axis of rotation of the said carousel.
Figure 6:
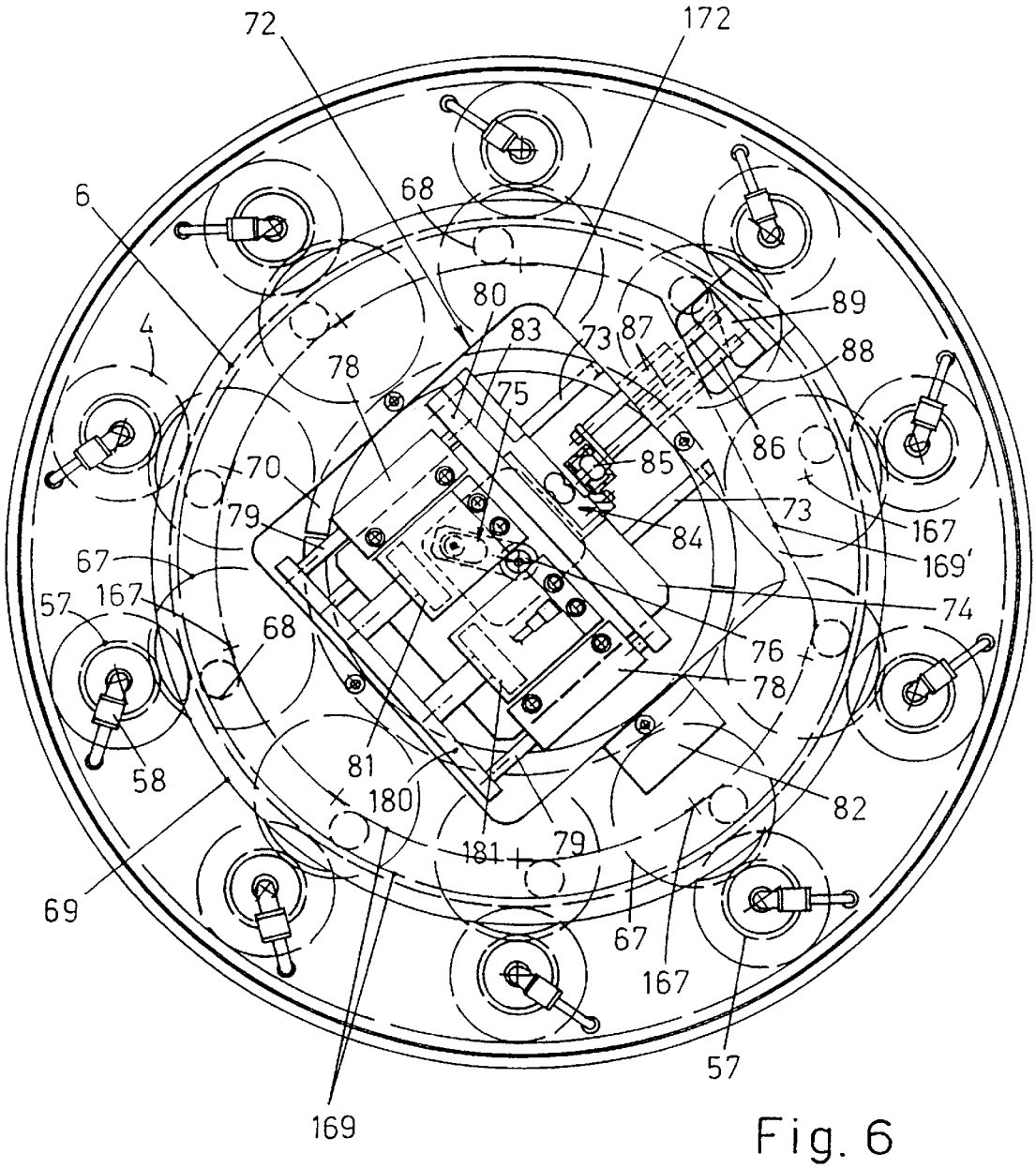
FIG. 6 is a top-down view of the top of the capping carousel seen in FIG. 5.

As can be seen in FIGS. 1, 5 and 6, the freewheeling gear 57 is in mesh with a gear 67 mounted so as to rotate via its vertical shaft 167 on the plate 1 and carrying an eccentric roller 68 with a vertical axis to engage with the annular grooved profile 169 of a flat cam 69 that is fixed via a collar 70 to a horizontal plate 71 integral with a fixed axial part 171 of the carousel. The profile 169 of the cam is characterized by a long section of circular form concentric with the axis of the carousel and by a short section in which the same profile maintains the circularity of the outer flank, while the inner flank becomes a straight chord, as indicated at 169' in FIG. 6, so that in this section the said grooved profile is broadened out to an appropriate extent towards the carousel axis. In the vicinity of this broadened section of the cam profile the body of the same cam has a side 172 of a window 72 of e.g. square shape, which exposes the greater part of the underlying plate 71. At right angles to the said side 172 of the window 72 are two horizontal guide rods 73 attached by their ends to the collar 70. A slider 74 runs on these rods and is hinged on the underside to the end of a slotted link 75 keyed to the end of a vertical tube 76. This tube rotates in the said fixed part 171 of the carousel and is connected at its lower end to precision means for modifying and stabilizing its angular position, which may be a servomechanism with encoder shown schematically at 77, designed for remote control via the machine control panel (see below). Mounted on the slider 74 are two guides 78 parallel to the rods 73 mentioned earlier: able to slide inside them are rods 79 whose ends are fixed to crossmembers 80, 180, of which crossmember 180 is connected to the rods of two piston/cylinder units 81, 181 that lie parallel with the rods 79 and whose bodies are fixed to the said slider 74. These cylinders are normally in the position of maximum extension of their rods, that is to say such as to hold crossmember 80 against the guides 78 and the cylinders are connected to a pneumatic logic circuit 82 mounted on the top face of the cam 69 and having the functions stated below. Fixed at 83 to one end of crossmember 80 is the end of an electrical load cell 84 parallel to the said crossmember and with its other end connected, via a joint 85, to a slider formed by two horizontal and mutually parallel rods 86. These lie at right angles to the said crossmember 80, slide in corresponding guide seats 87 within the body of the cam 69 and project into the initial section of the broadened section of the cam profile, where the said cam comprises a slot 88 which is parallel to the said seats 87 and in which a sliding wedge 89 is guided with its side at an angle to enable it to enter the cam 69 profile 169 from the outside and interfere by a predetermined amount, controllable remotely by means of the servomechanism 77, with the roller 68 of each gear 67 of each tool A of the capping carousel. In FIG. 6 the wedge 89 is illustrated in the position of maximum interference with the cam 69 profile.

The electrical lead 184 connected to the load cell 84 runs down the axial cavity of the tube 76 (FIG. 7) and connects to the machine control panel (see below).

The pneumatic logic circuit 82 is connected to one of the outlet lines 25 of the upper rotary distributor of the carousel and contains, for example, components comparable with the triggers and flip-flops of electronics, such that the cylinder 81 is normally kept extended with a pressure that tends to protect the load cell, that is to say by ensuring that the load cell is never stressed beyond a maximum predetermined value. The cylinder 181 on the other hand is normally not supplied with fluid. The circuit supplying cylinder 81 may contain, for example, a trigger that is thrown when a critical pressure is exceeded due to an anomalous stress on the load cell, and, after an interval of time such as to ensure that the roller 68 of the detected unit A has released the wedge 89, delay means cause a change of state in a flip-flop component which then supplies air to the cylinder 181 at a pressure that will ensure the rapid extension of the rod of this cylinder and the rapid return to rest of the entire movable system connected to this cylinder, after which the air supply is stopped and the tool returns to the start-of-cycle condition.

The operation of the tool will now be described beginning with the phase in which a cap C is screwed onto a bottle B, which is partly visible in FIG. 1. The carousel turns clockwise from the point of view of a person viewing FIG. 6 and the rollers 68 of the gears 67 of the various carousel tools A travel along the circular section of the cam 69 profile 169. The cap C held by the closed gripping head 47 (FIG. 1) comes towards and contacts the mouth of the bottle by the action of the cam 16 and rotates in the screwing direction by the engagement of the gear 4 with the epicyclic gears indicated partly at 6. The cap screws onto the bottle with a corresponding lowering of the tube 7 and a corresponding lowering of the piston 18, in opposition to the pneumatic pressure that is balancing the weight of the tool. If, during the lowering of the tool by the cam 16, the cap becomes stuck on the neck of the bottle and refuses to screw down, the tube 7 remains at a stationary height while the cylinder 11 continues to be lowered, thus reducing the volume of the chamber 20 as stated earlier.

While the cap is being screwed on, compressed air is being sent into the pressure chamber 51 to load the clutch 33 with the necessary force to reach the desired screwing torque at the cap—which is a value slightly less than the ideal predetermined maximum value. During the screwing of the cap the driven part 133 of the clutch rotates and with it the shafts 233 and 54, while the freewheel 57 remains stationary and the corresponding gear 67 also remains stationary, together with the roller 68 which travels in the circular section of the cam 69 profile 169. When the cap has been screwed to the tightening torque determined by the friction clutch 33, the compressed air supply to the chamber 51 is cut off at the appropriate moment so that the said clutch continues through the remaining part of the operating cycle with only the elastic load produced by the action of the pressure spring 42, the purpose here being to limit the friction, overheating and thereby protect the life and reliability of the clutch. The gripping head 47 stops and, with it, the driven parts of the clutch and the shafts 233, 54 cease to rotate. In the next step the rollers 68 on the gears 67 of the various tools A of the carousel (see FIG. 6) arrive at the broadened section of the cam 69 profile 169 and engage with the wedge 89 which, because of the degree of interference on the orbit of rotation of the rollers, causes an anticlockwise rotation of the gears 67 of a predetermined angular amplitude and this rotation is passed on through the freewheel 67 to the shaft assembly 54, 233, to the leg 133, to the gripping head 47 and so to the cap C, which is screwed with the predetermined tightening torque. It will be obvious that in this phase the gear pair 57, 67 and the entire assembly connected to the gripping head 47 starts from a situation of rest and that it is therefore free of inertia that could produce an error in the value of the transmitted twisting moment, thereby guaranteeing the operating precision of the entire tool. During this stage the interference of the roller 68 with the inclined surface 89 generates a force on the load cell 84, which produces a proportional signal by which it is possible to measure the tightening torque applied to the caps and it is consequently possible to certify the degree of closure of all the bottles treated by the capping carousel. If a cap or the neck of a bottle have defects, so that the load cell 84 detects a torque less than or greater than predetermined values, the corresponding bottle or bottles will be prepared for removal at the exit of the capping carousel by means of known type that will be notified of the successive linear and angular position of the bottles by encoders mounted on the central shaft of the capping carousel and on the subsequent means of conveyance of the bottles.

When the characteristics of the bottles and of their closing caps are varied it will be possible to adapt the capping carousel to the different screwing requirements of the caps by varying the pneumatic pressure in the chamber 51 and/or varying the degree of interference of the wedge 89 with the profile 169 of the cam 69 in accordance with a known program.

When the rollers 68 of the gears 67 leave the wedge 89, the same rollers engage with the rectilinear chord section 169' of the inner side of the cam 69 profile and are returned by the latter to the original angular position, serving for their reinsertion into the circular part of the cam profile.

Figure 7:
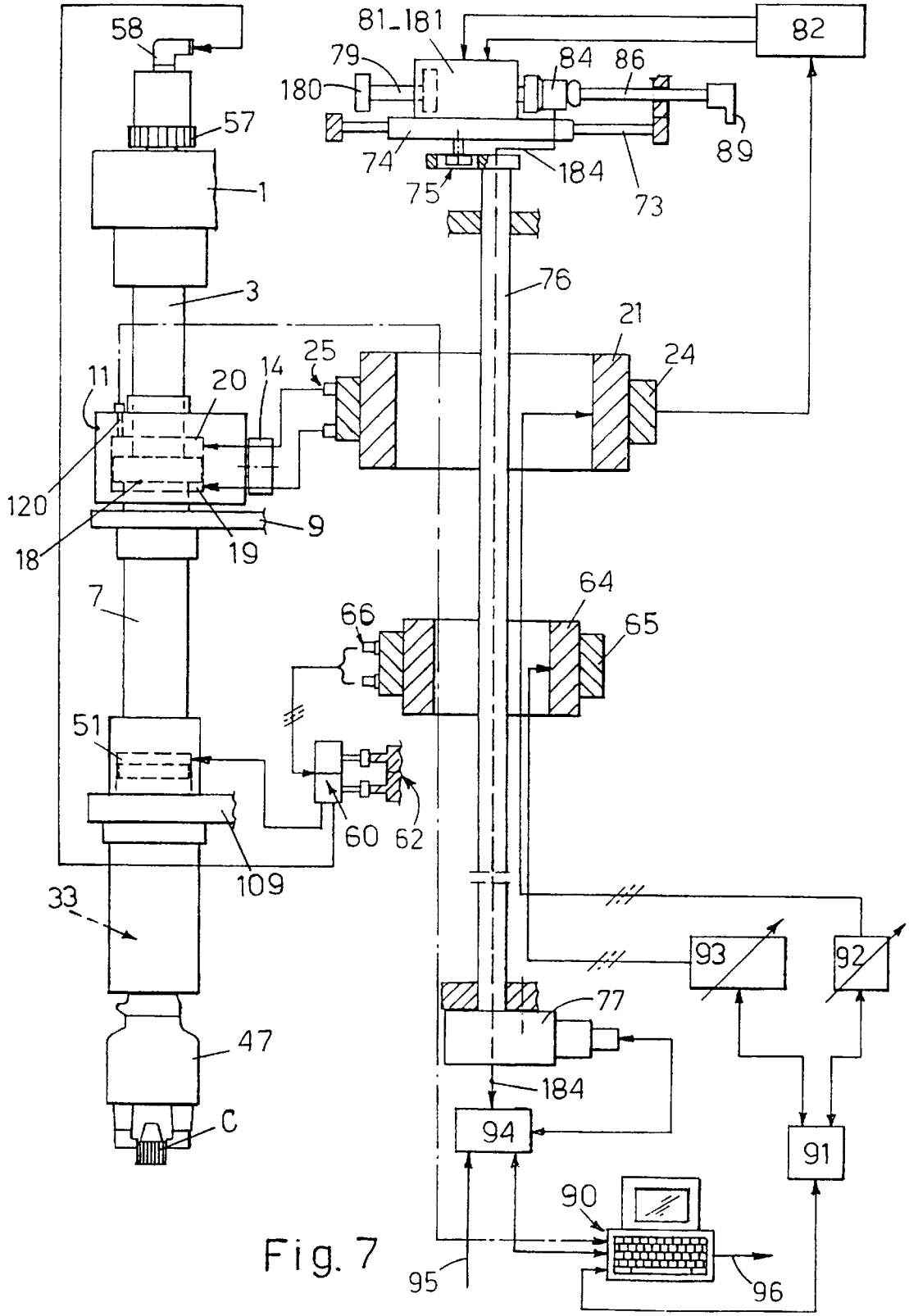
FIG. 7 is a schematic block diagram of the principal parts of the electrical and pneumatic circuit controlling the capping carousel with its tools according to the invention.

Referring to FIG. 7 it will be seen that by means of the processor 90 which controls the operation of the capping machine, it will be possible for example to control, by means of a suitable interface 91, a first pneumatic unit 92 which, by means of the upper rotary manifold 21, 24, supplies the chambers 19 and 20 of the various tools A at the pressure values required on each occasion for the weight of the gripping heads 47 and for the characteristics of the caps and of the bottles to be closed, and which supplies the pneumatic logic circuit 82 with the pressure(s) necessary for supplying at different times the cylinders 81, 181 which respectively damp out any anomalous stresses to which the load cell 84 may be subjected and return the latter to the rest position.

Using the processor 90 it will also be possible to control a second pneumatic unit 93 designed to provide pressure at values that may be selected according to the characteristics of the bottles and of their closure caps: the pressure is supplied via the lower rotary distributor 64, 65 and through the valves 60 to the rotary couplings 58 for the command to close the gripping heads 47 with a predetermined pressure and is sent to the lines 52 leading into the pressure chambers 51 of the piston/cylinder unit by which the clutch 33 is loaded to the maximum working pressure.

The servomechanism 77 that modifies the degree of interference of the wedge 89 with the orbit of rotation of the eccentric rollers 68 on the gears 67 of each tool, and that helps to modify the tightening torque applied to the screw caps, may be controlled by the processor 90 through another interface 94. The electrical lead 184 carrying the signal produced by the load cell 84 is connected to the interface 94 which can be prepared to use this signal as a feedback signal in order automatically to instruct the servomechanism 77 to modify the interference of the said wedge 89 to the value set by the working program of the processor. 95 denotes the phase signal input from the capping machine. If the processor 90 receives from the load cell incorrect values for the tightening torque of a cap and detects, via the optional sensor 120, defects in the first stage of the screwing of a cap, it will send a command through its output 96 for the removal from the processing line of the corresponding incorrectly closed bottle.

Figure 8A:
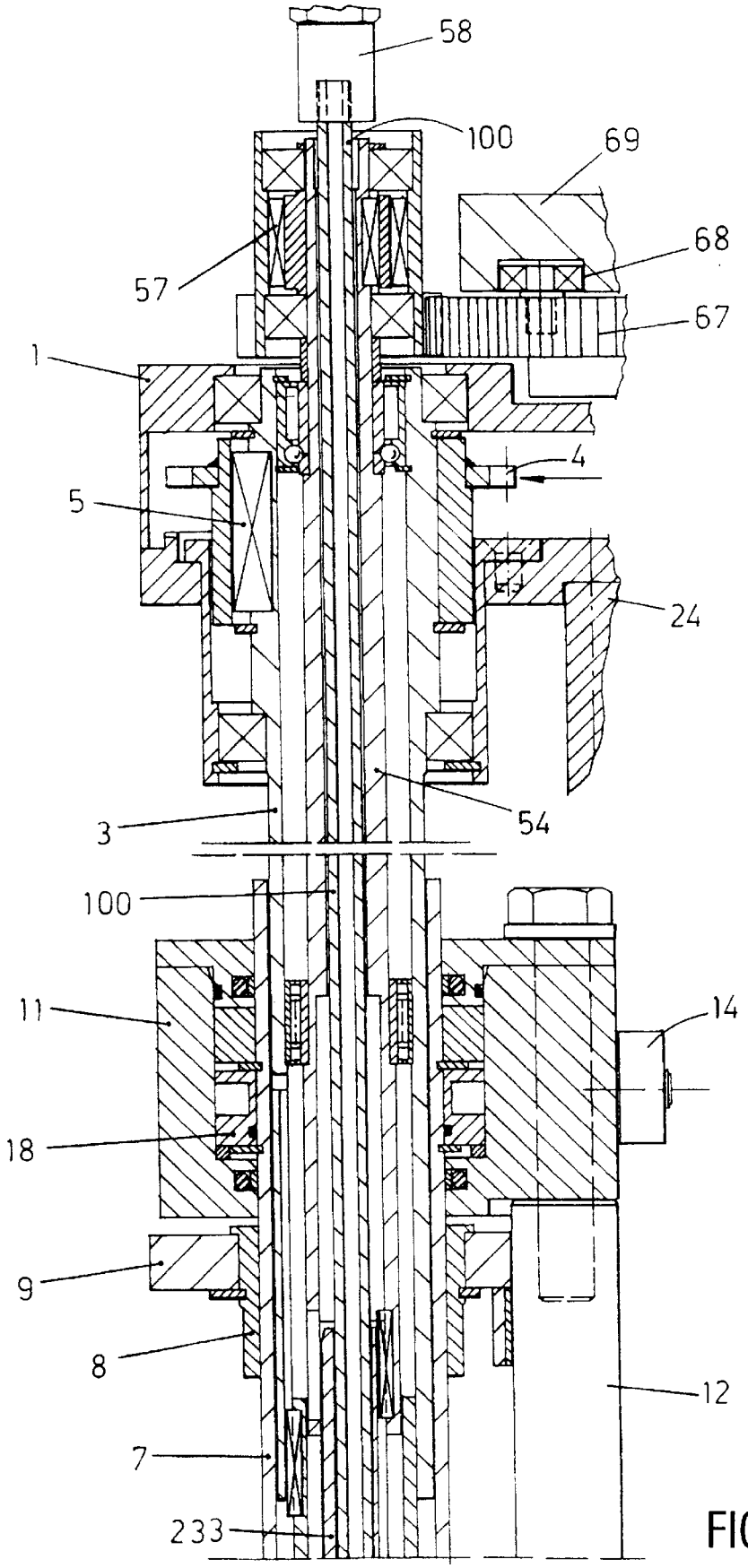
FIGS. 8*a* and 8*b* show in longitudinal section respectively the upper portion and the lower portion of a modified embodiment of one of the tools for screwing on a screw cap.
Figure 8B:
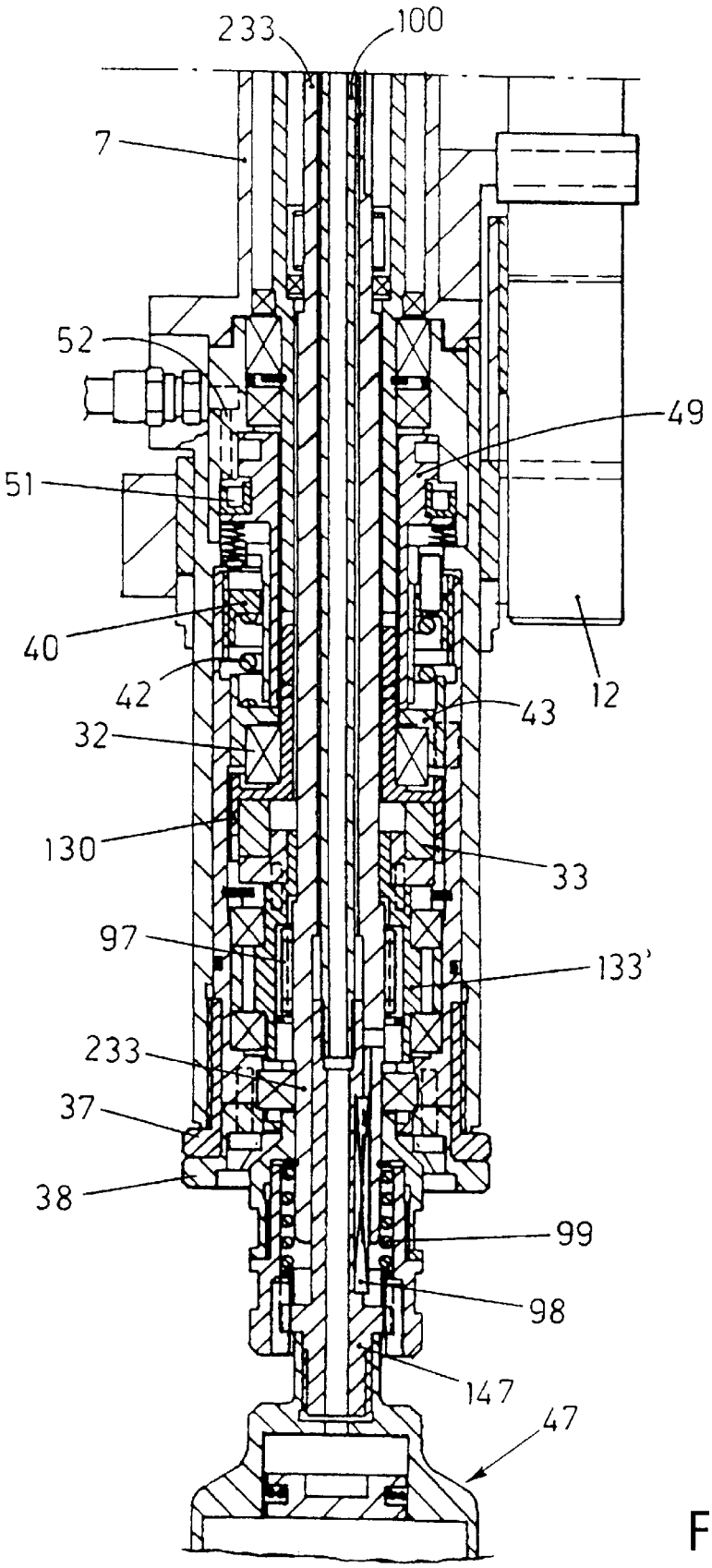

To the tool A for screwing on the cap C there can be made the following constructive modifications, which will be now described with particular reference to FIGS. 8*a* and 8*b*. It is to be noted that in accordance with the embodiment of FIG. 1, the driven portions of the clutch 33 are permanently connected with the shaft 233, also when the tool A performs the final screwing of the cap by means of the freewheel 57 and the wedge 89 as above mentioned. The frictions originated by the said driven parts of the clutch sum up with the resistance created by the cap during its screwing and can cause a distortion of response in the whole system. In order to eliminate this drawback, as shown in FIG. 8*b*, the shaft 233 is connected to the driven portion 133' of the clutch 33, with the interposition of a unidirectional coupling mechanism 97 of the type employed in the freewheel mechanisms, which is active whenever the motion must be transmitted from the driven portion 133' to the shaft 33 but which is inactive on the contrary case, so that when the shaft 233 is actuated for the final screwing of the cap, the whole driven assembly of the clutch is isolated.

The embodiment illustrated with reference to FIG. 1, which contemplates the use of the cylinder 11 with the lower pressure chamber 19 for the compensation of the weight of the assembly which carries the gripping head 47 and the upper pressure chamber 20, creates an elastic system which can give a relatively slow and not so accurate response. To the said inconvenience there can be obviated by eliminating the above mentioned pneumatic system, as shown in FIG. 8*a* and, as shown in FIG. 8*b*, the gripping head 47 is provided with a tang 147 telescopically mounted in the terminal portion of the shaft 233, rotatably coupled with this latter by means of the key 98 and prearranged in such a manner as to perform a limited axial movement against the action of a spring 99. Any resistance to the screwing of a cap originates a relative axial movement between the parts 147 and 233 with compression of the spring 99.

A further modification made to the solution according to FIG. 1 consists in the use of a small tube tightly connected to the upper end of the axially hollow tang 147 of the gripping head 47, said tube axially traversing the unit of the shafts 233 and 54 and projecting from the top end of this latter for its connection to the coupling 58 for the compressed air required for the operation of the gripping head 47. This solution simplifies the construction of the tool since it avoids the provision of air tight connections between said hollow shafts 233 and 54.

We claim:

1. A tool for capping containers with screw caps which said tool is mounted around a periphery of a rotating carousel with other identical said tools in a capping machine, said tool comprising:

a gripping head with which the cap is gripped and screwed onto the container;

a friction clutch having a driving part and a driven part connected to said gripping head;

a first torquing device which screws the cap on the container at a lower screwing torque which is lower than a predetermined maximum screwing torque for the cap, said first torquing device including a) a rotation means for providing axial rotation from rotary movement of the carousel to said driving part of said friction clutch, and b) a calibration mechanism by which the axial rotation of said rotation means provided to said driving means is calibrated to provide the lower screwing torque to said driven part and hence to said gripping head which lower screwing torque is lower than the predetermined maximum screwing torque for the cap; and a second torquing device which further screws the cap on the container to achieve a complete screwing of the cap on the container to the predetermined maximum screwing torque, said second torquing device including a) a freewheel in axial alignment with said friction clutch and connected to said driven part, b) a non-rotating mechanism which is connected to said freewheel to impart to said freewheel a rotation and hence to rotate said driven part after the lower screwing torque is applied to the cap, and c) a static opposing means which is engaged by said non-rotating mechanism upon rotation of said freewheel on the carousel so that said freewheel which is initially at a rest position without any inertia and hence said gripping head are then rotated, by engagement of said non-rotating mechanism with said static opposing means, through an adjustable and predetermined angle to achieve a complete screwing of the cap on the container to the predetermined maximum tightening force.

2. A tool for capping containers with screw caps as claimed in claim 1, further comprising:

a transducer means for detecting a stress to which said static opposing means is subjected by engagement with said non-rotating mechanism and for generating an electrical signal proportional to the maximum screwing torque; and a processing means for processing the electrical signal produced by said transducer means, for comparing the processed electrical signal with predetermined values, and for actuating a removal device for removal of a container from the carousel when the compared signals are indicative of a defectively screwed cap.

3. A tool for capping containers with screw caps as claimed in claim 2, wherein said friction clutch includes:

a pressure spring which clamps said driving part and said driven part together with a minimum load; and a pneumatic means for pneumatically clamping said driving part and said driven part together at a variable load in excess of the minimum load provided by said pressure spring only when said gripping head is screwing the cap to the container such that when said gripping head is not screwing the cap to the container only the minimum load of said pressure spring is clamping said driving part and said driven part together.

4. A tool for capping containers with screw caps as claimed in claim 3:

wherein said carousel of the capping machine includes a) a fixed part on which said static opposing means are mounted, b) an upper horizontal plate which rotates, which has bearings therein, and on which said non-rotating mechanism is mounted, c) an epicyclic gear which rotates as the upper plate rotates and which engages said fixed part, d) an intermediate horizontal plate fixed to said upper plate, e) a lower horizontal plate fixed to said intermediate plate, f) a roller, and g) an annular cam fixed coaxially to said fixed part and having a grooved lateral profile which said roller follows to move the container up to said gripping part;

wherein said rotation means includes a) a first vertical tube supported rotatably by the bearings of said upper plate, b) a gear keyed to said first tube which meshes with said epicyclic gear, c) a second vertical tube which is mounted telescopically and axially movable around an outside of a lower end of said first vertical tube, which is supported by said intermediate plate and said lower plate, and which is integral with said roller, d) an anti-rotation means for preventing said second tube from rotating relative to said intermediate plate, e) a weight compensating means for compensating for the weight of said second tube, said friction clutch and said gripping head relative to said intermediate plate, and f) a pipe which is mounted for rotation in said second tube, which is keyed to the lower end of said first tube for axial movement relative thereto, and which has a lower end connected to said driving part of said friction clutch;

wherein said friction clutch is mounted axially inside of said lower end of said pipe and includes a) a connection between said lower end of said pipe and said driving part, b) a quick action coupling between said driven part and said gripping head, and c) an adjusting means for adjusting the minimum load of said pressure spring;

wherein said gripping head includes a pneumatic holder for the cap; and wherein said second torquing device includes a) a composite drive shaft which has a modifiable length, which is rotatably mounted in said first tube, which extends into said second tube, which has a bottom end connected to said driven part, which is axially hollow, and which has a projection projecting from a top end of said first tube and keyed to said freewheel, and b) a rotary coupling connected to the projection of said composite drive shaft which supplies pressurized fluid through said composite drive shaft to said pneumatic holder of said gripping head.

5. A tool for capping containers with screw caps as claimed in claim 4:

wherein said weight compensating means includes a) a piston which is integral with the upper end of said second tube, b) a cylinder in which said piston slides and through which said second tube passes, said cylinder extending in a direction of an axis of rotation of said carousel, supporting said roller which is mounted on a horizontal axis, and having an upper chamber and a lower chamber formed on opposite sides of said piston, and c) an injection means for injecting into and maintaining a fluid at varying pressures in said chambers such that (i) a pressure in said lower chamber compensates for the weight of said second tube, said friction clutch and said gripping head relative to said intermediate plate, and (ii) a pressure in said upper chamber acts as a damper to provide a predetermined axial force of the cap on the container and so that if the cap becomes stuck and does not screw down said second tube does not move down as said roller moves in said annular cam; and wherein said anti-rotation means includes a) a vertical, downward-oriented plug which is fixed to said cylinder, b) a vertical seat which is fixed to said lower plate and in which said plug slides in a guided manner, and c) a bush which is integral with a projection on a side of said second tube and in which said plug is engaged.

6. A tool for capping containers with screw caps as claimed in claim 5, wherein said injection means of said weight compensating means includes a maintaining means for maintaining at preset and constant values the pressures injected in said upper and lower chambers even when a volume of said upper and lower chambers vary as said roller follows said annular cam.

7. A tool for capping containers with screw caps as claimed in claim 5, wherein said weight compensating means further includes a detecting means for detecting a reduction in volume of said upper chamber as said roller follows said annular cam during a downward capping action, said detecting means being connected to said processing means so that detection of a reduction in volume is sensed by said processing means as an anomaly of the screwing on of the cap.

8. A tool for capping containers with screw caps as claimed in claim 4:

wherein said friction clutch further includes a) a bell which is integral with the lower end of said pipe and which internally includes integral first discs spaced from one another, b) second discs spaced from one another and interleaved with said first discs, said second discs being fixed by keys to the bottom end of said drive shaft, c) a mushroom-shaped portion of said driven part which is axially hollow and which is keyed to the bottom end of said drive shaft, d) a bush which is housed in the lower end of said second tube, which includes bearings which mount said mushroom-shaped portion for rotation therein, and which extends vertically above said discs, e) a nut which is threadably received in the lower end of said second tube and which axially retains said bush in the lower end of said second tube, f) a ring which is threaded onto a top of said bush and which is engaged on a lower side thereof by said pressure spring, g) a pin which is integral with said second tube and which engages said ring to prevent said ring from rotating about said second tube, h) a retainer which bears against an upper part of said bell and which is engaged on an upper side thereof by said pressure spring such that by rotary movement of said bush said ring is threadably moved up and down relative to said bush to vary the clamping load exerted by said pressure spring on said discs, and i) a bearing which bears against said bell and which rotatably mounts said retainer about said pipe.

9. A tool for capping containers with screw caps as claimed in claim 8:

wherein said friction clutch further includes a) a collar which axially engages said nut, and b) screws which fix said collar to a bottom end of said bush such that rotation of said collar rotates said bush when said screws are loose but such that no rotation of said collar and said bush is possible when the screws are tightened which causes said collar to frictionally engaged said nut; and wherein said bush and said nut are removable from said second tube together with said discs, said bell, said mushroom-shaped portion and said pipe.

10. A tool for capping containers with screw caps as claimed in claim 8:

wherein said pneumatic means includes a) a hollow rod which is located axially inside of said ring, which is axially movable about said pipe, and which rests at a lower end thereof on said retainer, b) a piston which is integral with said hollow rod, c) a cylindrical chamber formed by a portion of said second tube and a top of said piston, and in which said piston axially moves along said second tube, and d) a fluid pressure means for supplying fluid pressure to said cylindrical chamber in order to increase the load on said discs.

11. A tool for capping containers with screw caps as claimed in claim 4:

wherein said carousel of the capping machine includes a) a secondary upper plate fixed to said upper plate, b) a second cam having a closed groove profile and fixed coaxial to said secondary upper plate, said profile having (i) a primary profile portion which is circular and concentric with an axis of rotation of said carousel for about 75% of a revolution, and (ii) a secondary profile for a remaining 25% of the revolution, said secondary profile having an outer flank which maintains a circularity of said primary profile portion and an inner flank which is straight and traces a chord, and c) a radial slot at a beginning of said secondary profile in the outer flank thereof;

wherein said freewheel of said second torquing device further includes a freewheeling gear mounted to the top end of said drive shaft;

wherein said non-rotating mechanism of said second torquing device further includes a) a corresponding gear which meshes with said freewheeling gear, which has a greater diameter than that of said freewheeling gear, and which is rotatably mounted about a vertical axis to said upper plate, and b) a roller which is mounted on a vertical axis to a face of said corresponding gear at an eccentric position to the vertical axis of said corresponding gear and which engages said second cam; and wherein said opposing means includes a) a wedge in said slot having a slopping face sloping towards the inner flank of said secondary profile, and b) a guide means for mounting said wedge in said slot such that said slopping face of said wedge is engaged by said roller as said roller moves along the outer flank of said secondary profile of said second cam, such that as said wedge is engaged by said roller an angular rotation of defined amplitude is imparted to said roller which is in turn imparted through said freewheeling gear to said gripping head and hence to the cap, and such that after passing said wedge said roller returns to an original angular position by engagement with the straight inner flank of said secondary profile.

12. A tool for capping containers with screw caps as claimed in claim 11:

wherein said carousel of the capping machine includes a) an intermediate collar which is supported by said secondary upper plate and which in turn supports said second cam, and b) a window in a center of said second cam;

wherein said opposing means includes a) a pair of horizontal guide rods which have ends supported by said intermediate collar and which are oriented parallel to a longitudinal axis of said radial slot, b) a horizontal slider which is mounted to said pair of guide rods and which moves thereby in said window, c) a slotted link connected to an underside of said horizontal slider, d) a vertical tube positioned axially and having an upper end to which said slotted link is connected, e) a servomechanism connected to a lower end of said vertical tube by which a position of said slider is modified, f) a plurality of guides mounted to said slider parallel to said guide rods, g) a corresponding plurality of respective rods which run in a respective said guide, h) proximal and distal cross members which are parallel and which connect together proximal and distal ends of said rods running in said plurality of guides, said proximal cross member being adjacent said wedge, i) a load cell having a first end fixed to said proximal cross member and a second end, j) a joint to which the second end of said load cell is connected, k) a pair of horizontal rods which are attached at one end to said joint, which are parallel to said plurality of guides, and which carry at the other end said wedge, l) guide seats formed in said second cam in which said pair of horizontal rods slide, m) at least one piston/cylinder unit which is attached to said slider, and which loads said load cell mounted to said proximal cross member towards an end-of-travel position at said plurality of guides, n) an air pressure supply which feeds air to said piston/cylinder unit such that said piston/cylinder unit reacts elastically and protects said load cell if said load cell is subjected to excessive force during an interference of said wedge and said roller, and o) a means for detecting a load exerted on said load cell and for indicating a value for an effective screwing torque exerted on the cap screwed onto the container, said means for detecting including an electrical lead running from said load cell and through an axial cavity in said vertical tube.

13. A tool for capping containers with screw caps as claimed in claim 12:

wherein said opposing means further includes a) a second piston/cylinder unit which is parallel to said first-mentioned piston/cylinder unit, and b) a controlling logic device which connects said first-mentioned piston/cylinder unit to said air pressure supply and which also connects said air pressure supply to said second piston/cylinder unit upon activation of said first-mentioned piston/cylinder unit to rapidly return to a rest position said load cell after a delay which allows said roller to disengage from said wedge.

14. A tool for capping containers with screw caps as claimed in claim 12:

wherein said carousel of the capping machine further includes a) a processor which controls an automatic operation of the capping machine, b) an interface connected to said processor, c) a first pneumatic unit which is connected to said interface and which supplies a constant pressure compressed air, d) a first rotary distributor which is connected to said first pneumatic unit, which is arranged coaxially in an upper part of said carousel, and which distributes the compressed air to (i) said upper chamber and said lower chamber of said cylinder and (ii) said controlling logic device, e) a second pneumatic unit which supplies a variable pressure compressed air and which is connected to said interface, f) a second rotary distributor which is connected to said second pneumatic unit, and which is arranged coaxially in a lower part of said carousel, g) a first cam actuated valve which is mounted on a rotary part of said carousel, and which has an outlet connected to a rotary coupling which supplies air pressure to said gripping head, h) a second cam actuated valve which is mounted on the rotary part of said carousel, and which has an outlet connected to a rotary coupling which supplies air pressure to a pressure chamber which loads said friction clutch with an axial load, and i) a monitoring logic unit which is connected to said processor, which receives an electrical signal from said load cell, which receives a phase signal from the capping machine, and which compares the electrical signal from said load cell and the phase signal from said capping machine with predetermined values such that if the predetermined value is exceeded said processor commands a defectively screwed cap and an associated container to be removed from the capping machine, said monitoring logic unit also being connected to said servomechanism such that a feedback signal of the electrical signal is used to modify the position of said slider.

15. A tool for capping containers with screw caps as claimed in claim 4, wherein said second torquing device further includes a freewheel mechanism which connects said driven part with said composite shaft and which is active only for transmitting motion from said friction clutch to said composite drive shaft when said freewheel is driven.

16. A tool for capping containers with screw caps as claimed in claim 12:

wherein the upper end of said second tube is integral with said roller;

wherein said friction clutch further includes a) a tang which is fitted into and keyed for axial movement to the lower end of said composite shaft and which is attached to said gripping head for rotating said gripping head, and b) a spring which is compressed by an axial movement of said tang when said gripping head meets resistance to the screwing of the cap onto the container.

17. A tool for capping containers with screw caps as claimed in claim 16:

wherein said tang is axially hollow;

wherein said friction clutch further includes a small tube which axially traverses said composite shaft, which is connected at a lower end to said tang, which projects upwardly from said composite shaft and connects to said rotary coupling.

* * * * *